US006220562B1

(12) United States Patent
Konkle

(10) Patent No.: US 6,220,562 B1
(45) Date of Patent: Apr. 24, 2001

(54) FURNITURE TIPPING RESTRAINT

(75) Inventor: Douglas R. Konkle, Wabash, IN (US)

(73) Assignee: B. Walter & Co., Inc., Wabash, IN (US)

( * ) Notice: Subject to any disclaimer, the term of this patent is extended or adjusted under 35 U.S.C. 154(b) by 0 days.

(21) Appl. No.: 09/203,186

(22) Filed: Nov. 30, 1998

(51) Int. Cl.[7] ..... A47B 97/00

(52) U.S. Cl. ..... 248/500; 24/298; 248/499; 248/510

(58) Field of Search ..... 248/499, 500, 248/501, 680, 681, 74.3, 117.6, 502, 503, 222.41, 222.12; 410/97, 10, 7, 8; 312/351.7; 52/23, 155; 24/17 B, 17 AP, 116 A, 298

(56) References Cited

U.S. PATENT DOCUMENTS

| | | | | |
|---|---|---|---|---|
| 406,623 | | 7/1889 | Brinkerhoff . | |
| 454,111 | | 6/1891 | Coupe . | |
| 3,664,163 | | 5/1972 | Foote . | |
| 3,729,778 | * | 5/1973 | McGrath | 24/73 |
| 3,937,436 | * | 2/1976 | Steward | 248/499 |
| 4,183,121 | | 1/1980 | Cousins . | |
| 4,288,188 | * | 9/1981 | Smith | 410/97 |
| 4,526,020 | | 7/1985 | Fey et al. . | |
| 4,566,665 | | 1/1986 | Rynearson . | |
| 4,669,695 | | 6/1987 | Chou . | |
| 4,754,948 | | 7/1988 | Casciani . | |
| 4,826,193 | | 5/1989 | Davis . | |
| 4,879,964 | * | 11/1989 | Emerson, Jr. | 24/298 |
| 4,890,813 | | 1/1990 | Johnson et al. . | |
| 5,076,525 | | 12/1991 | Whipple . | |
| 5,174,543 | | 12/1992 | Corson et al. . | |
| 5,176,437 | | 1/1993 | Remington . | |
| 5,192,123 | | 3/1993 | Wallin . | |
| 5,208,952 | | 5/1993 | Mintel et al. . | |
| 5,330,148 | * | 7/1994 | Floyd | 248/499 |
| 5,349,834 | | 9/1994 | Davidge . | |
| 5,398,383 | * | 3/1995 | Bingold | 24/16 PB |
| 5,431,365 | | 7/1995 | Hopkins . | |
| 5,462,250 | * | 10/1995 | Fells | 248/371 |
| 5,529,276 | * | 6/1996 | Szablya | 248/548 |
| 5,599,000 | | 2/1997 | Bennett . | |
| 5,624,098 | | 4/1997 | McDowell . | |
| 5,699,993 | | 12/1997 | Hill et al. . | |
| 5,704,582 | * | 1/1998 | Golembiewski et al. | 248/500 |
| 5,734,556 | * | 3/1998 | Saneinejad et al. | 361/719 |
| 5,908,274 | * | 6/1999 | Silberman | 410/10 |
| 5,983,573 | * | 11/1999 | MacKarvich | 52/23 |

FOREIGN PATENT DOCUMENTS 1023726 1/1978 (CA) .

OTHER PUBLICATIONS

Mommy's Helper Inc., Tip–Resistant Furniture Safety Brackets packaging and product copies (5 sheets).

* cited by examiner

*Primary Examiner*—Anita M. King
*Assistant Examiner*—Tan Le
(74) *Attorney, Agent, or Firm*—George Pappas

(57) ABSTRACT

A furniture tipping restraint for use in helping to prevent furniture such as chests of drawers, bookcase shelves, television carts, etc., from tipping over and away from a building wall. The furniture tipping restraint includes a first anchor which is attached to the wall whereagainst the furniture is located and a second anchor which is attached to the back wall of the furniture. A restraint strap extends through holes in both of the anchors and includes a clamping aperture at one end thereof for receiving the other end of the restraint strap for forming a loop and thereby tying together the anchors and effectively restraining the furniture from tipping away from the wall. In another embodiment, a restraint strap includes a securement portion for attachment directly to either a wall or the furniture. An attachment clamp also includes a securement portion and is attached directly to either the wall or the furniture. The restraint strap is selectively detachably attachable to the attachment clamp for thereby restraining the furniture from tipping away from the wall.

11 Claims, 2 Drawing Sheets

FURNITURE TIPPING RESTRAINT

TECHNICAL FIELD

In general, the present invention relates to the technical field of devices for preventing the inadvertent tipping of furniture. More particularly, the present invention relates to devices wherethrough furniture which is placed generally against a wall is prevented from tipping away therefrom.

BACKGROUND OF THE INVENTION

Furniture such as chests of drawers, bookcases, television carts, etc., have been very widely commonly used in homes for their intended purposes. Unfortunately, pursuant to reports by the United States Consumer Products Safety Commission, thousands of injuries and several deaths have occurred to children as a result of such furniture being tipped over. It is reported that most of these injuries involved furniture with drawers such as dressers and chests of drawers and, further, that most of these injuries occurred to children under the age of 5. It is believed that young children try to pull themselves up or climb the chests of drawers or bookcases thereby causing them to tip over.

As a result of these reports and current awareness of the problem, some furniture manufacturers have been asked to modify the design of their furniture so as to hopefully prevent or decrease the possibility that the furniture could be tipped over. As can be appreciated, however, furniture such as chests of drawers, television carts and bookcase shelves have been standardized for many years and modifications, for example, to the dimensions of such furniture for preventing inadvertent tipping, in general, makes such furniture unusable or cumbersome for their intended purpose and are essentially unacceptable to typical consumers. As a result, it is recommended and most preferable that such furniture be placed as far back as possible against a wall and that braces or anchors be used to secure the furniture to the floor or wall. Although such furniture anchors and/or braces can be effective in preventing the furniture from tipping over, they must not be cumbersome, difficult to install, or expensive, so that they will readily and widely be used by most consumers.

Accordingly, a need exists for a furniture tipping restraint which can easily be installed, which would not detract from the appearance of the furniture, is generally inexpensive, and which is effective in helping to prevent furniture from inadvertently being tipped over and potentially causing injury.

SUMMARY OF THE INVENTION

It is the principal object of the present invention to overcome the above-discussed problems associated with furniture inadvertently being tipped over and to provide a furniture tipping restraint which meets the above-discussed needs.

The present invention overcomes such problems by providing a furniture tipping restraint which is adapted to be attached between the back wall of a piece of furniture and the house wall whereagainst the furniture is located such that the furniture is restrained from easily being tipped over away from the wall. The furniture tipping restraint includes a first anchor which is attachable to a house wall adjacent the location whereat the piece of furniture is to be located. The anchor is attached to the wall preferably using a screw, drywall anchor, nail or other equivalent fastener. A second anchor is provided and is attached to the back wall of the piece of furniture with a screw, nail or other suitable fastener. Thereafter, after locating the piece of furniture generally against the house wall and in close proximity where it will ultimately be located, thereby also placing the first and second anchors generally close to one another, a restraint strap is extended between the first and second anchors and is attached thereto thereby essentially restraining or flexibly attaching the piece of furniture to the house wall. The restraint strap is generally elongate and flexible for allowing the final positioning of the piece of furniture as may be desired. The restraint strap is minimized in its length so that, in the event the piece of furniture is inadvertently caused to start tipping, it will provide a force backwardly toward the wall. Because the restraint strap is maintained at a minimum length, the required force backwardly toward the wall to prevent tipping is minimized since it is applied to the furniture before the center of gravity of the furniture reaches the plane after which the furniture will continue tipping or fall over. This required force is further minimized by locating the furniture tipping restraint on the furniture back wall vertically as high as possible.

Preferably, the restraint strap is made of flexible nylon or plastic and is adapted to extend through holes in the first and the second anchors. The restraint strap includes a loop clamp whereby, after it is extended through the anchor holes, a first end of the restraint strap is attached to the other end or portion of the restraint strap thereby forming a loop tying together the first and second anchors. The second end of the restraint strap is detachably attachable by the loop clamp so that, if one desires to move the furniture, the restraint strap is merely removed from the anchors thereby freeing the piece of furniture for moving as may be desired. The loop clamp is preferably attachable substantially along any portion of the restraint strap so that the loop length can be varied and minimized. More preferably, the loop clamp includes an aperture wherethrough the second end of the restraint strap is received and pulled through for minimizing the overall loop length. Yet more preferably, the clamping aperture is keyhole shaped having a keyhole slot and the restraint strap second end includes a plurality of beads located in staggered relation longitudinally along the restraint strap such that, upon threading the restraint strap second end through the keyhole shaped aperture and reaching the desired loop length, the restraint strap is forced into engagement within the keyhole slot so as to be frictionally engaged therein and such that the beads of the restraint strap essentially positively lock the restraint strap in the keyhole slot. For releasing and removing the restraint strap, the restraint strap second end is merely pushed out of the keyhole slot and the strap second end is pulled out of the keyhole shaped aperture thus disrupting the loop and allowing the removal of the restraint strap from the anchors.

In a second embodiment, the restraint strap is provided with a securement portion whereby the restraint strap is directly attachable to a wall or a piece of furniture. The securement portion includes a hole for receiving a fastener such as a screw, drywall anchor, nail or other suitable fastener. An attachment clamp is provided and also has a securement portion for selectively attaching the attachment clamp directly to a wall or piece of furniture. Similarly, the securement portion of the attachment clamp includes a hole for receiving a fastener such as a screw, drywall anchor, nail or other suitable fastener for thereby attaching the attachment clamp to either a wall or piece of furniture. The restraint strap is selectively attachable to the attachment clamp for thereby essentially attaching the piece of furniture to the wall and restraining it from tipping over and away from the wall. Preferably, the attachment clamp includes an aperture wherethrough the restraint strap is received and is selectively frictionally engaged for detachably attaching the restraint strap to the attachment clamp. Thus, unlike the first embodiment, in this embodiment a loop is not created by the restraint strap but, rather, the restraint strap is merely directly selectively attached to the attachment clamp. More preferably, the attachment clamp aperture is keyhole shaped with a keyhole slot and the restraint strap includes a plurality of beads located in a staggered relation longitudinally along the restraint strap.

In operation, after, for example, the restraint strap is attached to the house wall and the attachment clamp is attached to the back wall of a piece of furniture such as a chest of drawers and the chest of drawers is pushed in close proximity to the house wall placing the restraint strap generally close to the attachment clamp, the restraint strap end is threaded through the attachment clamp keyhole shaped aperture for minimizing the length thereof to the attachment clamp and, thereafter, the restraint strap is pushed into and is frictionally engaged in the keyhole slot thereby attaching and locking the restraint strap to the attachment clamp. For moving the furniture, the restraint strap is merely pushed out of frictional engagement from within the keyhole slot and the restraint strap is pulled out of the attachment clamp aperture, thereby freeing the furniture from the house wall and allowing movement thereof as may be desired. Preferably, the restraint strap and securement portion thereof are made of nylon or plastic and are made by injection molding and are integrally formed together. Similarly, the attachment clamp and securement portion thereof are also preferably made of plastic or nylon and are made by injection molding and are integrally formed together.

In one form thereof, the present invention is directed to a furniture tipping restraint including a first anchor attachable to a wall and a second anchor attachable to a piece of furniture. A restraint strap is provided and is selectively extendable between the first and second anchors and is attachable thereto whereby the piece of furniture is restrained from tipping away from the wall.

In one form thereof, the present invention is directed to a furniture tipping restraint including a restraint strap having a. securement portion which is selectively attachable to a wall or piece of furniture. An attachment clamp having a securement portion is also provided and is selectively attachable to a wall or piece of furniture. The restraint strap is selectively attachable to the attachment clamp whereby the piece of furniture is restrained from tipping away from the wall.

BRIEF DESCRIPTION OF THE DRAWINGS

The above-mentioned and other features and objects of this invention and the manner of obtaining them will become more apparent and the invention itself will be better understood by reference to the following description of the embodiment of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE PREFERRED EMBODIMENT

Figure 1:
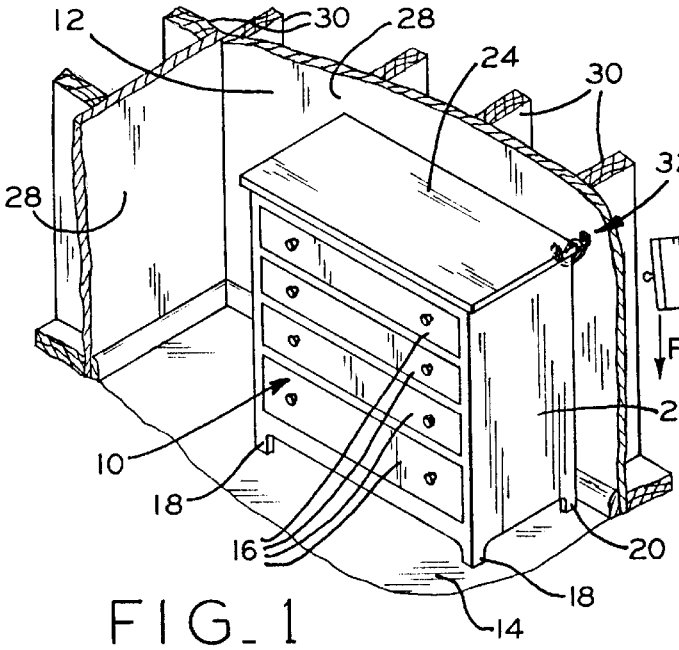
FIG. 1 is a perspective view of a chest of drawers against a house wall and, wherein, a furniture tipping restraint constructed in accordance with the principles of the present invention has been installed between the chest of drawers and house wall.

Referring initially to FIG. 1, a piece of furniture in the form of chest of drawers, generally designated by the numeral 10, is shown adjacent a house wall 12 and on a floor 14. The chest of drawers 10, includes a plurality of drawers 16, front legs 18, back legs 20, a back wall 22, top 24 and sides 26. As is most common, the chest of drawers 10 is located and placed adjacent a house wall 12 with the chest of drawers back wall 22 generally adjacent or against the drywall or lath 28 which is supported by wood studs 30. It is noted that the chest of drawers 10 is depicted herein merely as an exemplary piece of furniture upon which the furniture tipping restraint generally designated by the numeral 32 may be used and that restraint 32 can be used on any piece of furniture which can be located adjacent a house wall 12. Additionally, house wall 12 made of drywall or lath 28 and wood studs 30 is also merely exemplary and it should be noted that the furniture tipping restraint 32 can be used with any type of wall construction including, for example, concrete blocks, solid wood, etc.

Figure 2:
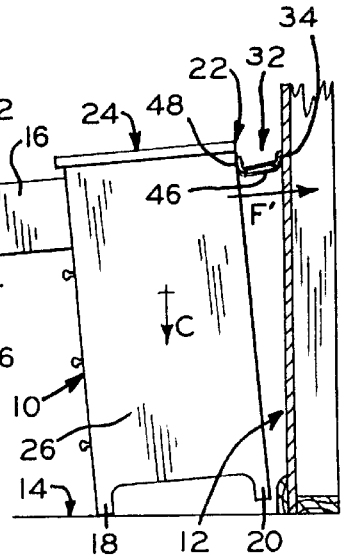
FIG. 2 is a side elevation view of the chest of drawers and furniture tipping restraint shown in FIG. 1 and, further, showing the furniture tipping restraint preventing the chest of drawers from tipping away from the house wall.

As shown in FIGS. 1 and 2, the furniture tipping restraint 32 is attached to and between the chest of drawers back wall 22 and the house wall 12. In this fashion, for example, as shown in FIG. 2, if the top drawer 16 is pulled out and a force F is applied downwardly thereon such as that which may be applied by a small child hanging thereon, if the chest of drawers 10 starts to tip over by pivoting about the front legs 18, the furniture tipping restraint 32 effectively holds back the chest of drawers 10 close to the house wall 12 thereby preventing the chest of drawers 10 from completely tipping over onto the floor 14. The furniture tipping restraint 32 essentially provides an opposing force as indicated by arrow F' to restrain the chest of drawers 10 from tipping away from the wall 12. The length of the furniture tipping restraint 32 is minimized and made as short as possible so that the restraining force F' is applied to the chest of drawers 10 as soon as possible after it starts to tip so as to prevent the center of gravity diagrammatically depicted by arrow C from moving away from the house wall 12 and beyond the chest front legs 18. In this manner, the restraining force F' required to prevent tipping is maintained at a minimum for effectively preventing the chest of drawers 10 from tipping over and away from the wall 12.

Figure 3:
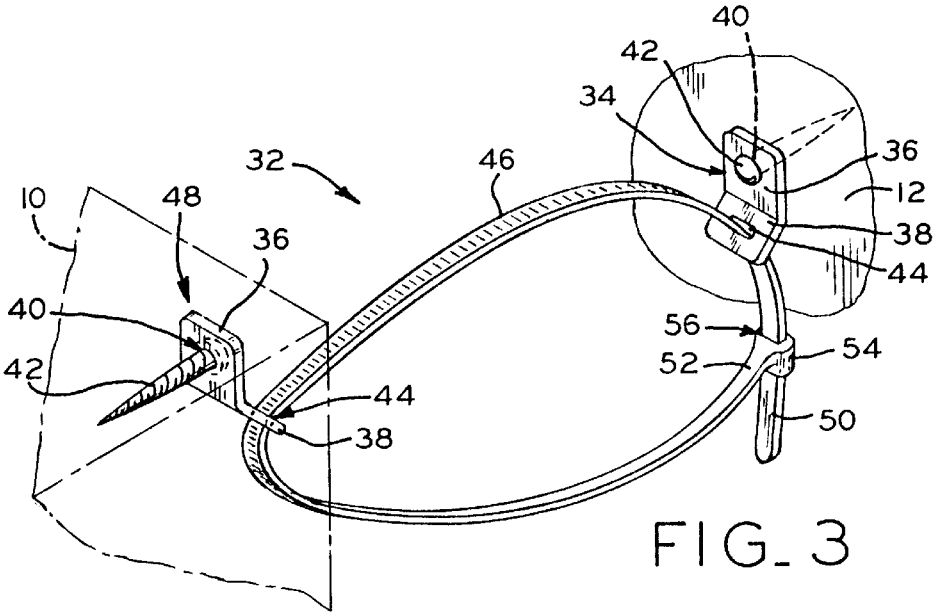
FIG. 3 is a perspective view of a furniture tipping restraint constructed in accordance with the principles of the present invention.

Referring now to FIG. 3, a furniture tipping restraint 32 is shown constructed in accordance with the principles of the present invention and attached to and between a wall 12 and piece of furniture such as a chest of drawers 10. The furniture tipping restraint 32 includes a first anchor or bracket 34 having a toe portion 36 and ear portion 38. Preferably, first anchor 34 is made of steel by a stamping process and with the ear portion 38 being bent at an angle from the toe portion 36 as shown. A hole 40 is provided in the toe portion 36 for receiving a screw 42 therethrough and mounting the anchor 34 to the wall 12. Preferably, screw 42 is sufficiently long and is located for attachment to a wood stud 30. In the alternative, a drywall or concrete anchor (not shown) can be used in conjunction with screw 42 for attaching the anchor 34 to the wall 12. The ear portion 38 is also provided with a hole 44 having any desired shape such as elongate as shown or circular. Hole 44, as more fully discussed hereinbelow, is adapted to receive therethrough the restraint strap 46.

The furniture tipping restraint 32 also includes a second anchor or bracket 48 which is essentially identical to the first anchor 34. The second anchor 48, however, is attached via the screw 42 to the back wall 22 of a piece of furniture as best seen in FIG. 3.

The restraint strap 46 shown in FIG. 3 can be similar to commonly available wire ties having a first end 50 and a second end 52. The restraint strap 46 is preferably made of flexible plastic or nylon by an injection molding process. At the second end 52, a loop clamp 54 is provided and is integrally formed therewith. Loop clamp 54 includes a clamping aperture 56 wherethrough the first end 50 of the restraint strap 46 is received and retained so as to form a loop as shown. The loop clamp 54 and clamping aperture 56 thus operate to selectively attach and lock in place a portion of the restraint strap so as to form a loop of a desired length. The loop clamp 54 can be of a type which attaches to the restraint strap without allowing detachment or can be of a type which detachably attaches to any portion of the restraint strap 46 for allowing the user to selectively also remove the restraint strap second end from the clamping aperture 56 and opening the loop without having to break the restraint strap 46.

Figure 4:
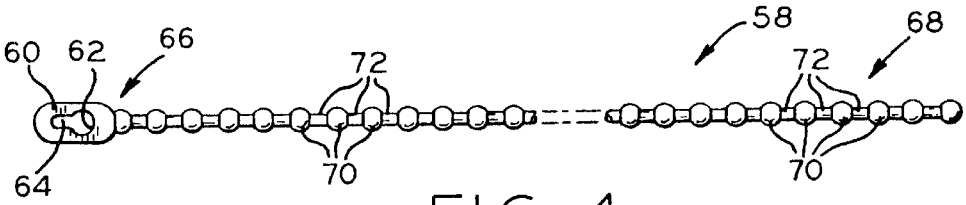
FIG. 4 is a plan view of another embodiment of a restraint strap usable in the furniture tipping restraint embodiment shown in FIG. 3.

In an alternative embodiment shown in FIG. 4, a restraint strap 58 is show which is preferably also made of flexible plastic or nylon by an injection molding process. The restraint strap 58 includes a loop clamp 60 having a keyhole shaped clamping aperture 62 including a keyhole slot 64. Similar to restraint strap 46, the loop clamp 60 is located at the second end 66 of the restraint strap, whereas the first end 68 is flexible and is selectively inserted through the loop clamp aperture 62. However, the first end 68 of the restraint strap 58 is formed with a plurality of beads or spheres 70 which are located in staggered relation longitudinally along the restraint strap intermediate rod shaped sections 72. It is noted that the sphere shaped or bead portions 70 and the rod sections 72 are injection molded and integrally formed together as shown.

In use, the restraint strap 58 is used quite similar to the restraint strap 46. After the anchors 34 and 38 are attached to the wall 12 and the back wall 22 of the piece of furniture is placed close to the back wall 12 placing the anchors 34 and 48 relatively close to one another, the restraint strap first end 68 is threaded through the holes 44 of both anchors 34 and 48 and the first end 68 is threaded through the keyhole shaped clamping aperture 62 so as to form a loop. After minimizing the overall length of the loop, the restraint strap first end is forced from the clamping aperture 62 toward the keyhole slot 64 thereby forcing a rod shaped section 72 to enter into and become frictionally engaged within the keyhole slot 64. In this regard, it is noted that the width of the keyhole slot 64 is slightly smaller than the diameter of the rod shaped sections 72 for providing a positive frictional engagement. Additionally, because the beads 70 are located on both sides of the rod shaped section 72, the first end 68 is positively locked in position generally without possibility that the restraint strap can be pulled out of the keyhole slot unless it is again pushed out therefrom and into the clamping apertures 62.

Referring now to FIGS. 5–9, a second embodiment of a furniture tipping restraint generally designated by the numeral 74 is shown. Furniture tipping restraint 74 achieves the same result as the furniture tipping restraint 32 of preventing a piece of furniture such as a chest of drawers 10 from tipping over and away from a wall 12. Furniture tipping restraint 74 includes a restraint strap 76 shaped quite similar to the first end 68 of restraint strap 58 and, in this regard, the same numerals 68, 70 and 72 are used to designate the restraint strap first end 68, beads or spheres 70 and the rod shaped sections 72. At its second end 78, however, restraint strap 76 is provided with a securement portion 80 for selectively attaching the restraint strap 76 to either the wall 12 or a piece of furniture such as a chest of drawers 10. Preferably, the securement portion 80 includes a frusto-conical shaped hole 82 for receiving a screw or other fastener therethrough and attaching to a wall or piece of furniture in a manner as described hereinabove with respect to anchors 34 and 48. The securement portion 80 is preferably also made of plastic or nylon and is injection molded along with the first end 68 and is, thus, integrally formed therewith.

The furniture tipping restraint 74 further includes an attachment clamp 84 having a securement portion 86 attached thereto via a neck section 88. Attachment clamp 84 is quite similar to the attachment or loop clamp 60 of FIG. 4 and has a correspondingly similar keyhole shaped clamping aperture 62 and keyhole slot 64. Additionally, the securement portion 86 is generally similar to the securement portion 80 and includes a frusto-conical hole 82 therethrough for receiving a screw 42 or other fastener for attaching to either the wall 12 or a piece of furniture such as chest of drawers 10. Preferably, the attachment clamp 84, neck portion 88, and securement portion 86 are made of plastic or nylon and are integrally formed and made by injection molding.

Figure 5:
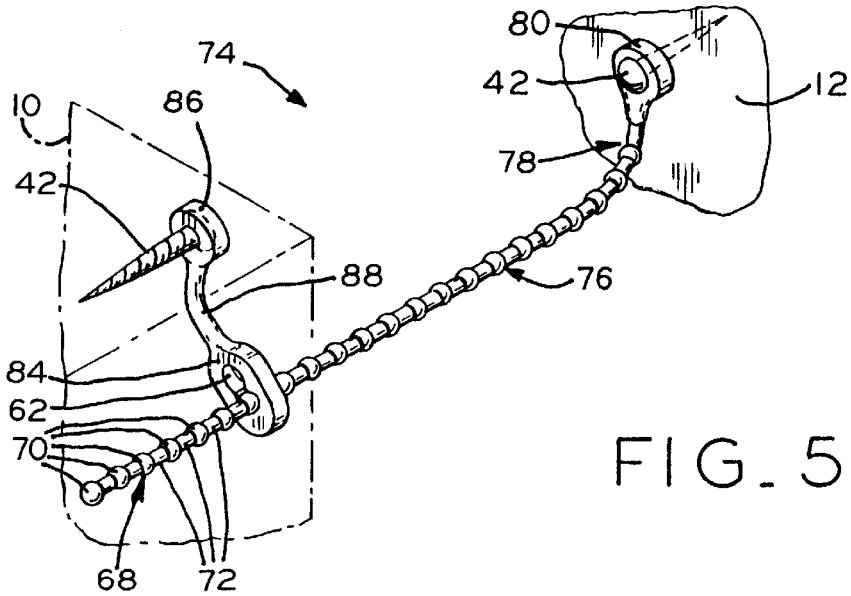
FIG. 5 is a perspective view of a second embodiment of a furniture tipping restraint constructed in accordance with the principles of the present invention.
Figure 6:
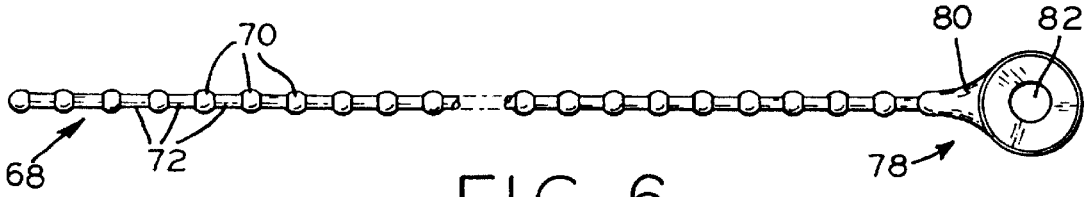
FIG. 6 is a plan view of the restraint strap and securement portion of the furniture tipping restraint shown in FIG. 5.
Figure 7:
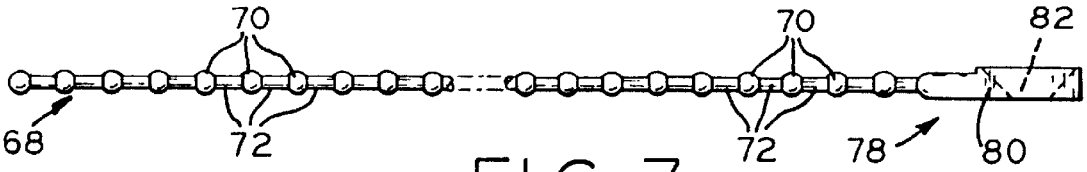
FIG. 7 is a side elevation view of the restraint strap shown in FIG. 6.
Figure 8:
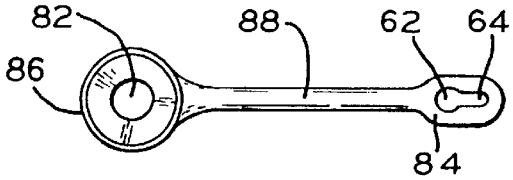
FIG. 8 is a plan view of the attachment clamp and securement portion of the furniture tipping restraint shown in FIG. 5; and, FIG. 9 is a side elevation view of the attachment clamp and securement portion shown in FIG. 8.
Figure 9:
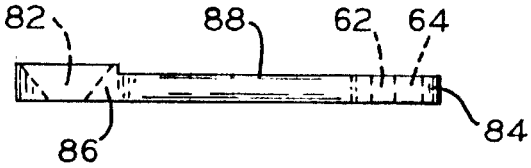

In operation, the furniture tipping restraint 74 is used by attaching the restraint strap 76 using the securement portion 80 thereof to the wall 12 or chest of drawers 10. The attachment clamp 84 is then secured using the securement portion 84 thereof to the chest of drawers 10 or wall 12. The chest of drawers 10 is then brought in close proximity to the wall 12 placing the attachment clamp 84 close to the restraint strap 76. The restraint strap 76 is then threaded through the clamping aperture 62 minimizing the length thereof and the restraint strap 76 is pushed into the keyhole slot 64 for causing one of the rod shaped sections 72 to be frictionally engaged within the keyhole slot 64 with beads 70 adjacent thereto located on either side of the attachment clamp 84. In this fashion, the restraint strap 76 is generally positively locked in the position as shown in FIG. 5 for thereby also preventing the chest of drawers 10 or other piece of furniture from being tipped over and away from the wall 12. When desired, the restraint strap 76 can be merely pushed out of the keyhole slot 64 and into the clamping aperture 62 for threading out and removing the restraint strap 76 from the attachment clamp 84 thereby freeing the piece of furniture 10 for moving away from the wall 12 as may be desired.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A furniture tipping restraint comprising:

a first anchor attachable to a wall;

a second anchor attachable to a piece of furniture;

a restraint strap selectively extendable between said first and second anchors and attachable thereto, whereby the piece of furniture is restrained from tipping away from the wall;

wherein both of said first and second anchors include a hole, said restraint strap being selectively extendable through both of said first anchor hole and said second anchor hole;

wherein said restraint strap includes a loop clamp whereat a first end of said restraint strap can be selectively attached, said restraint thereby forming a loop;

wherein said loop clamp includes a clamping aperture wherethrough said first end of said restraint strap is received and selectively attached for forming a loop; and, wherein said clamping aperture is keyhole shaped having a keyhole slot and said restraint strap first end includes a plurality of beads located in staggered relation longitudinally along said restraint strap, said restraint strap first end being selectively received and frictionally engagable in said keyhole slot for thereby selectively attaching said restraint strap first end to said loop clamp.

2. The furniture tipping restraint of claim 1, wherein said restraint strap is made of plastic.

3. The furniture tipping restraint of claim 1, wherein said restraint strap is made of nylon.

4. A furniture tipping restraint comprising:

a first anchor attachable to a wall;

a second anchor attachable to a piece of furniture;

a restraint strap selectively extendable between said first and second anchors and attachable thereto, whereby the piece of furniture is restrained from tipping away from the wall;

wherein said restraint strap includes a loop clamp whereat a first end of said restraint strap can be selectively attached, said restraint thereby forming a loop;

wherein said loop clamp includes a clamping aperture wherethrough said first end of said restraint strap is received and selectively attached for forming a loop; and, wherein said clamping aperture is keyhole shaped having a keyhole slot and said restraint strap first end includes a plurality of beads located in staggered relation longitudinally along said restraint strap, said restraint strap first end being selectively received and frictionally engagable in said keyhole slot for thereby selectively attaching said restraint strap first end to said loop clamp.

5. The furniture tipping restraint of claim 4, wherein said restraint strap is made of plastic.

6. The furniture tipping restraint of claim 4, wherein said restraint strap is made of nylon.

7. A furniture tipping restraint comprising:

a restraint strap having a securement portion being selectively attachable to a wall or piece of furniture;

an attachment clamp having a securement portion being selectively attachable to a wall or piece of furniture;

said restraint strap being selectively attachable to said attachment clamp whereby the piece of furniture is restrained from tipping away from the wall;

wherein said restraint strap securement portion includes a hole for receiving a fastener therethrough, whereby said restraint strap is selectively attachable to a wall or piece of furniture;

wherein said attachment clamp securement portion includes a hole for receiving a fastener therethrough, whereby said attachment clamp is selectively attachable to a wall or piece of furniture;

wherein said attachment clamp includes an aperture wherethrough said restraint strap is received and is selectively attached for thereby selectively attaching said restraint strap to said attachment clamp; and, wherein said attachment clamp aperture is keyhole shaped having a keyhole slot and said restraint strap includes a plurality of beads located in staggered relation longitudinally along said restraint strap, said restraint strap being selectively frictionally engagable within said keyhole slot for thereby selectively attaching said restraint strap to said attachment clamp.

8. The furniture tipping restraint of claim 7, wherein said restraint strap is made of nylon with its securement portion and hole integrally formed therewith and wherein said attachment clamp is made of nylon with its securement portion and hole and said keyhole aperture integrally formed therewith.

9. The furniture tipping restraint of claim 7, wherein said restraint strap and attachment clamp are made of nylon.

10. The furniture tipping restraint of claim 7, wherein said restraint strap and said attachment clamp are made of plastic.

11. A furniture tipping restraint comprising:

a restraint strap having a securement portion being selectively attachable to a wall or piece of furniture;

an attachment clamp having a securement portion being selectively attachable to a wall or piece of furniture;

said restraint strap being selectively attachable to said attachment clamp whereby the piece of furniture is restrained from tipping away from the wall;

wherein said attachment clamp includes an aperture wherethrough said restraint strap is received and is selectively attached for thereby selectively attaching said restraint strap to said attachment clamp; and, wherein said attachment clamp aperture is keyhole shaped having a keyhole slot and wherein said restraint strap is selectively received and frictionally engagable within said keyhole slot for thereby selectively attaching said restraint strap to said attachment clamp.

* * * * *